US008490894B2

(12) United States Patent
Lu et al.

(10) Patent No.: US 8,490,894 B2
(45) Date of Patent: Jul. 23, 2013

(54) MULTI-FUNCTION SHOWER HEAD STRUCTURE

(75) Inventors: Zhongping Lu, Fujian (CN); Shuiming Xu, Jian (CN); Hui Chen, Wuyishan (CN)

(73) Assignee: Ateck (Xiamen) Showers Co., Ltd., Xiamen, Fujian (CN)

( * ) Notice: Subject to any disclaimer, the term of this patent is extended or adjusted under 35 U.S.C. 154(b) by 156 days.

(21) Appl. No.: 12/960,591

(22) Filed: Dec. 6, 2010

(65) Prior Publication Data

US 2011/0133003 A1 Jun. 9, 2011

(30) Foreign Application Priority Data

Dec. 7, 2009 (CN) ..... 2009 2 0181697 U

(51) Int. Cl.
*A62C 31/02* (2006.01)

(52) U.S. Cl.
USPC ..... 239/394; 239/587.5; 239/561

(58) Field of Classification Search
USPC ..... 239/390, 391, 392, 394, 442–447, 239/537, 538, 540, 560, 561, 587.5, 587.6
See application file for complete search history.

(56) References Cited

U.S. PATENT DOCUMENTS

| | | | | |
|---|---|---|---|---|
| 497,480 | A * | 5/1893 | Thies | 239/446 |
| 2,132,333 | A * | 10/1938 | Sargent et al. | 239/394 |
| 2,272,593 | A * | 2/1942 | Andrle | 239/273 |
| 2,538,211 | A * | 1/1951 | Prout | 239/446 |
| 3,998,390 | A * | 12/1976 | Peterson et al. | 239/394 |
| 7,427,038 | B2 * | 9/2008 | Wang et al. | 239/240 |

* cited by examiner

*Primary Examiner* — Christopher Kim

(57) ABSTRACT

A multi-function shower head structure includes a connection base, a valve bolt, a guide bolt, a housing and a plurality of spray units. The connection base is used to connect external water and is connected with the valve bolt. The guide bolt is pivoted to the valve bolt. The guide bolt has an axial conducting hole and a guide channel to communicate with the conducting hole. The conducting hole can be rotated about the valve bolt, such that the valve bolt guides the water of the connection base to the conducting hole of the guide bolt for a guide channel to output water. The housing has a hole seat. The hole seat has a pivot hole for connection of the guide bolt. The spray units are disposed in the housing. Each spray unit has a water chamber. The guide channel of the hole seat has a plurality of spaced branch channels corresponding to the respective water chambers to communicate with the pivot hole. When the housing is turned about the guide bolt, the branch channels are changed to communicate with the guide channel for different spray modes, providing a user-friendly effect.

11 Claims, 8 Drawing Sheets

MULTI-FUNCTION SHOWER HEAD STRUCTURE

BACKGROUND OF THE INVENTION

1. Field of the Invention

The present invention relates to a multi-function shower head structure to provide different spray modes and to adjust its spray angle.

2. Description of the Prior Art

Nowadays, a shower head is an essential apparatus for taking a shower. The function of a conventional shower head cannot be enhanced because of its structure. For example, only a spray unit can be installed inside the shower head, without different spray modes. The user is unable to select a desired spray mode. Therefore, an improved shower head is developed, referring to Taiwan Patent No. 091113868, which provides different spray modes. But, this kind of shower head is expensive and its structure is complicated. Accordingly, the inventor of the present invention has devoted himself based on his many years of practical experiences to provide a multi-function shower head structure which is cost-effective and also provides various spray modes.

SUMMARY OF THE INVENTION

The primary object of the present invention is to provide a multi-function shower head structure which comprises a guide bolt, a housing and a plurality of spray units. The guide bolt has an axial conducting hole and a guide channel to communicate with the conducting hole to output water. The housing has a hole seat. The hole seat has a pivot hole for connection of the guide bolt. The spray units are disposed in the housing. Each spray unit has a water chamber. The guide channel of the hole seat has a plurality of spaced branch channels corresponding to the respective water chambers to communicate with the pivot hole. When the housing is turned about the guide bolt, the branch channels are changed to communicate with the guide channel for different spray modes. The present invention can be operated with ease, has a simple configuration, and is cost-effective.

Preferably, the multi-function shower head structure further comprises a connection seat and a valve bolt. The connection base has a connection hole and a flow channel for supplying water. The valve bolt is connected to the connection base. The guide bolt is pivoted to the valve bolt, such that the conducting hole of the guide bolt can be rotated about the valve bolt. The valve bolt has an inlet and an outlet to communicate with the flow channel and the conducting hole of the guide bolt. Thus, the spray units of the housing can be turned to adjust the angle of inclination of the desired spray unit, providing a user-friendly effect.

DETAILED DESCRIPTION OF THE PREFERRED EMBODIMENTS

Figure 1:
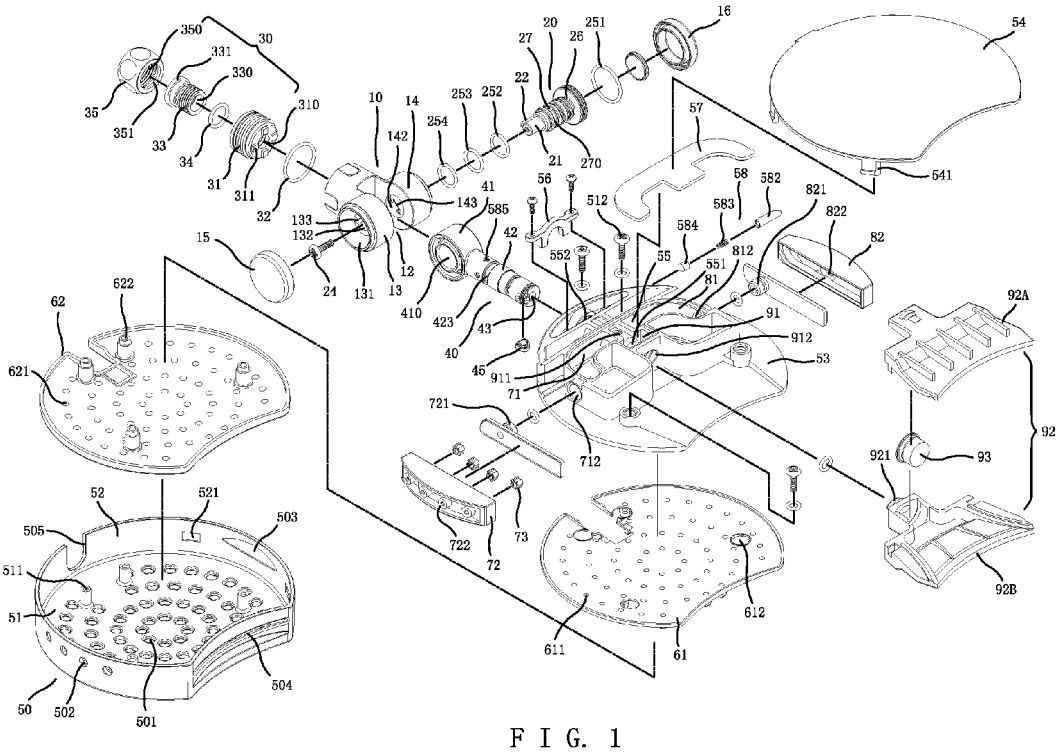
FIG. 1 is an exploded view according to a preferred embodiment of the present invention.
Figure 2:
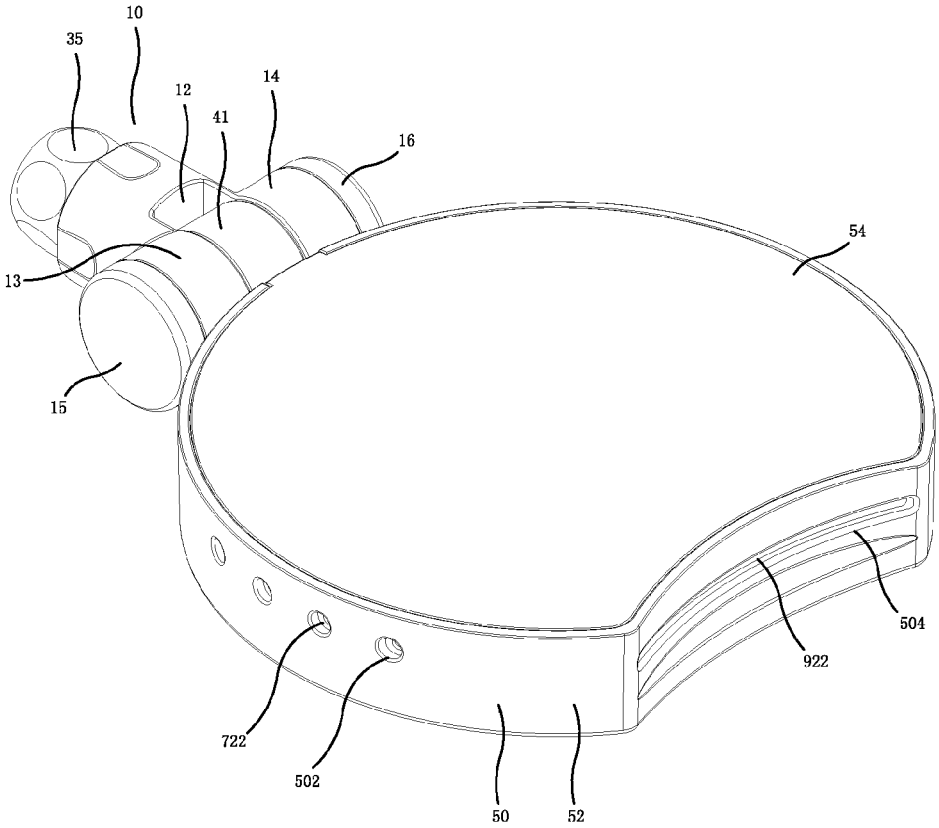
FIG. 2 is a perspective view according to the preferred embodiment of the present invention.
Figure 3A:
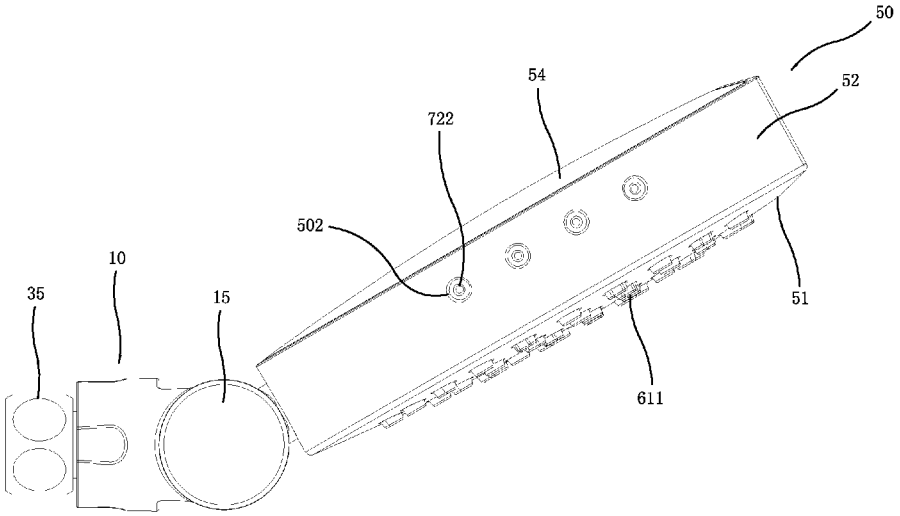
FIG. 3A and FIG. 3B are side views according to the preferred embodiment of the present invention.
Figure 3B:
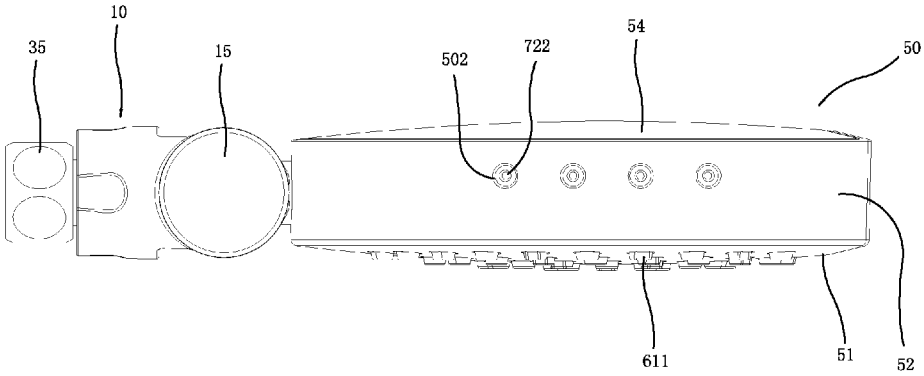
Figure 4:
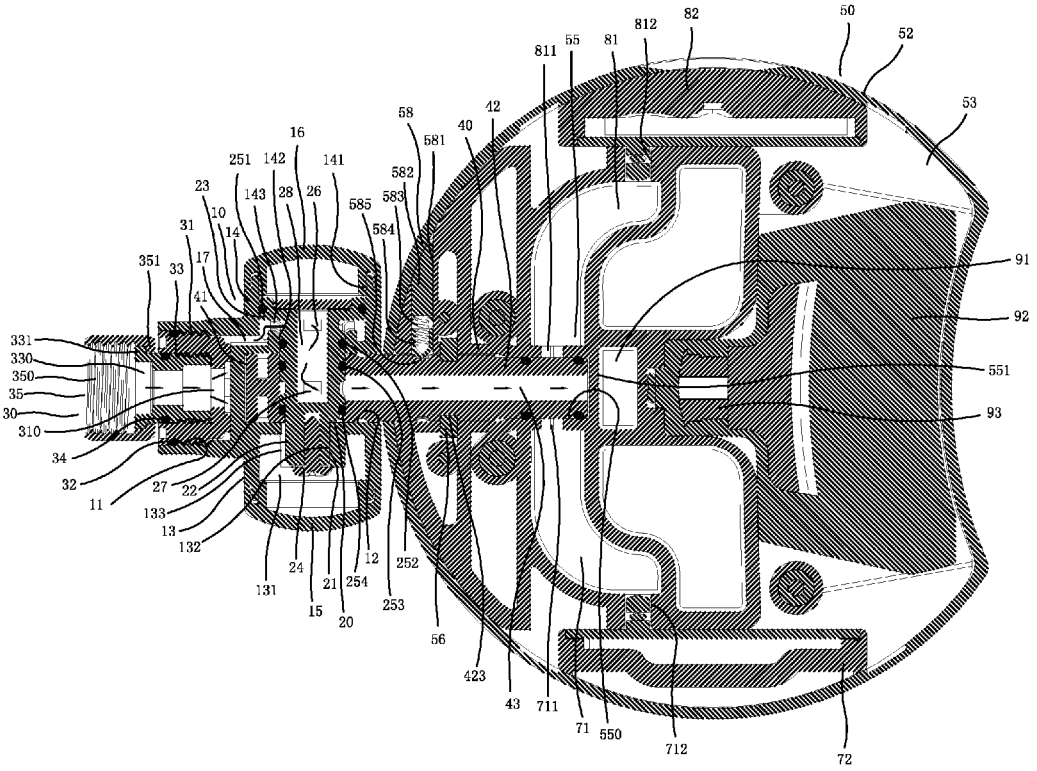
FIG. 4 is a cross-sectional view of FIG. 2.

Embodiments of the present invention will now be described, by way of example only, with reference to the accompanying drawings.

As shown in FIGS. 1, 2, 4, and 5A, a multi-function shower head structure according to a preferred embodiment of the present invention comprises a connection base 10, a valve bolt 20, a connector assembly 30, a guide bolt 40 and a housing 50.

The connection base 10 has a threaded connection hole 11 at one end thereof, a rotation space 12 at a central portion thereof, a left connection block 13 and a right connection block 14 at two sides of the rotation space 12. The two connection blocks 13,14 have sink holes 131,141, and lids 15,16 to cover the sink holes 131,141, and through holes 132,142 in the sink holes 131,141. The two through holes 132, 142 are disposed on the same central axis which is intersected with the rotation space 12. The left connection block 13 further has a keyway 133 in the through hole 132. The right connection block 14 has spacers 143 at an outer end of the through hole 142. A flow channel 17 is formed between every two of the spacers 143. The flow channel 17 communicates with the connection hole 11.

The valve bolt 20 has a shaft 21 inserting in the through holes 132, 142 of the two connection blocks 13, 14. The shaft 21 is across the rotation space 12, and has a key rib 22 to engage with the keyway 133. One end of the shaft 21 is an enlarged end 23 to lean against the spaces 143, and another opposing end of the shaft 21 is locked in the through holes 132, 142 with a screw 24. The valve bolt 20 comprises a first washer 251 on the enlarged end 23 to seal the sink hole 141 and a second washer 252 on the shaft 21 to seal the through hole 142, preventing the right connection block 14 from leakage. The valve bolt 20 further comprises a third washer 253 and a fourth washer 254 on the shaft 21 within the rotation space 12, an annular groove 270 on the shaft 21 between the third washer 253 and the fourth washer 254, an outlet 27 under the annular groove 270. The shaft 21 has an inlet 26 corresponding in position to the flow channel 17, a shaft hole 28 communicating with the inlet 26 and the outlet 27 for the outlet 27 to output water.

Figure 6:
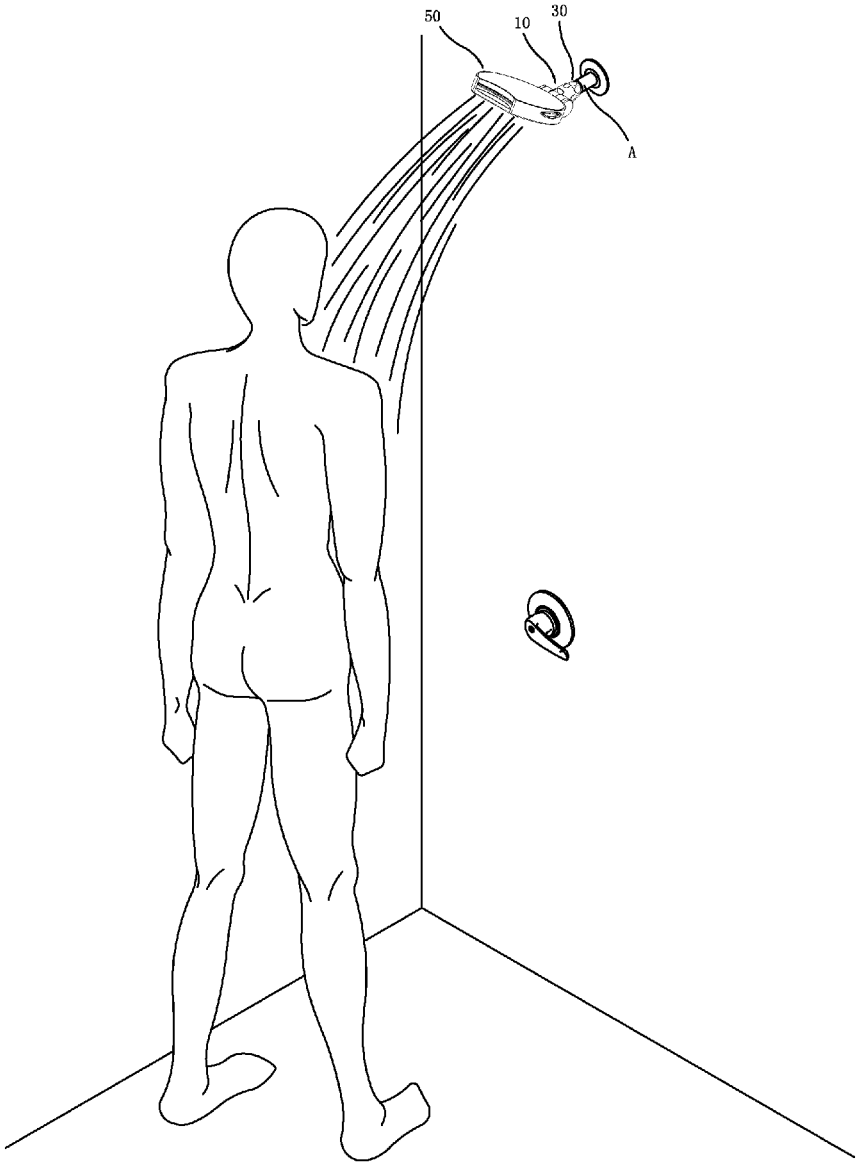
FIG. 6 is a schematic view showing the preferred embodiment of the present invention installed to a wall-mounted steel pipe.
Figure 7:
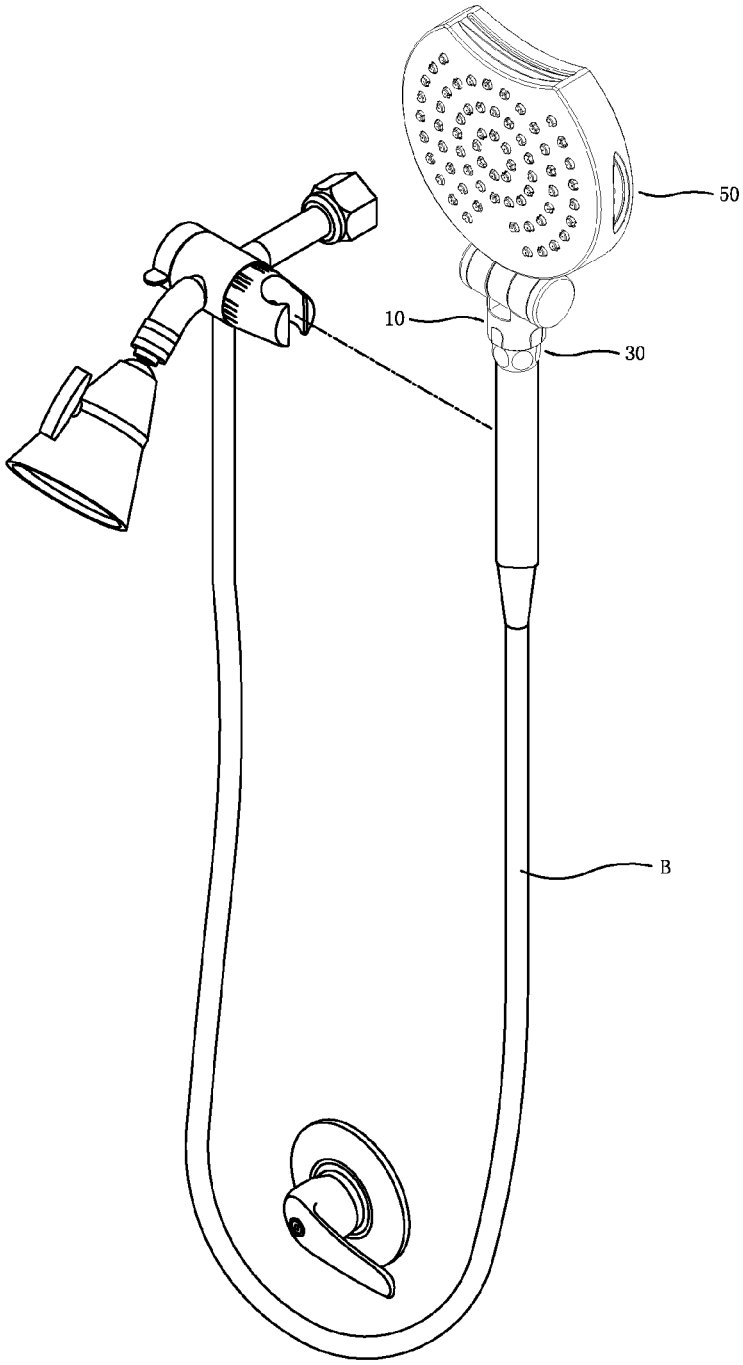
FIG. 7 is a schematic view showing the preferred embodiment of the present invention installed to a hose.

The connector assembly 30 is connected to the connection hole 11, and comprises an intermediary ring 31. The intermediary ring 31 has an inner end provided with spaced stop blocks 311, a central guide hole 310 to communicate with the flow channel 17. A threaded sleeve 33 is screwed in the guide hole 310 of the intermediary ring 31. A washer 32 is provided between the connection hole 11 and the intermediary ring 31 and a washer 34 is provided between and the intermediary ring 31 and the threaded sleeve 33 so as to prevent water leakage. The threaded sleeve 33 has a central sleeve hole 330 to communicate with the flow channel 17. The threaded sleeve 33 has an enlarged shoulder 331 at an outer end thereof. The shoulder 331 protrudes out of the connection hole 10 and the intermediary ring 31 to connect with a stepped hole 351 of a nut 35. The nut 35 has an inner threaded hole 350 to communicate with the sleeve hole 330. The inner threaded hole 350 is adapted for connection of a steel pipe A shown in FIG. 6 or a hose B shown in FIG. 7 to supply water to the annular groove 270 of the valve bolt 20. The connector assembly 30 of the present invention discloses the intermediary ring 31 to connect with the standardization threaded sleeve 33 and the nut 35 when the inner threads of the connection hole 11 are fixed in order to apply for the steel pipe A or the hose B in different standardizations.

The guide bolt 40 has a head end 41 to be received in the rotation space 12. The head end 41 has coupling holes 410 to receive the third washer 253 and the fourth washer 254. The guide bolt 40 further comprises a bolt shaft 42 opposite to the head end 41. The central axis of the bolt shaft 42 is perpendicular to that of the valve bolt 20. The bolt shaft 42 has an axial conducting hole 43 to communicate with the annular groove 270 of the valve bolt 20 for water entering the valve bolt 20. Spaced washers 421, 422 are provided on the end of the bolt shaft 42 opposite to the head end 41. The bolt shaft 42 has a guide channel 44 between the spaced washers 421, 422. The guide channel 44 communicates with the conducting hole 43. The guide channel 44 has an opening facing downward to supply water downward. A sleeve 45 is provided in the guide channel 44. The bolt shaft 42 has a narrowed engaging groove 423 thereon.

The housing 50 comprises a face panel 51, a trunk portion 52 extending upward from the face panel 51, a base 53 secured in the trunk portion 52, a cover 54 on top of the trunk portion 52, and a hole seat 55 fixed on the base 53. The face panel 51 has a plurality of spaced support pillars 511 thereon and a plurality of first water holes 501. The trunk portion 52 has four second water holes 502 which are transversely disposed on one side of the trunk portion 52, an oval-shaped third water hole 502 on an opposing side of the trunk portion 52, and a slot-shaped fourth water hole 504 disposed between the second water holes 502 and the third water hole 503. The trunk portion 52 further has an insertion trough 505 corresponding in position to the hole seat 55 for the bolt shaft 42 to pass therethrough. The trunk portion 52 has lock holes 521 for engagement of lock rods 541 of the cover 54. The hole seat 55 has a pivot hole 550 at an outer end thereof for insertion of the bolt shaft 42 of the guide bolt 40. The inner end of the hole seat 55 is sealed by a block plate 551. The bolt shaft 42 with the spaced washers 421, 422 is coupled in the pivot hole 550. The hole seat 55 has an open slot 552 corresponding in position to the engaging trough 423 of the bolt shaft 42 to communicate with the engaging trough 423. The engaging trough 423 and the open slot 552 are able to accommodate a stop seat 56. The stop seat 56 is locked on the base 53, preventing the bolt shaft 42 from axial movement along the pivot hole 550, so that the housing 50 is able to turn about the guide bolt 40.

Figure 5A:
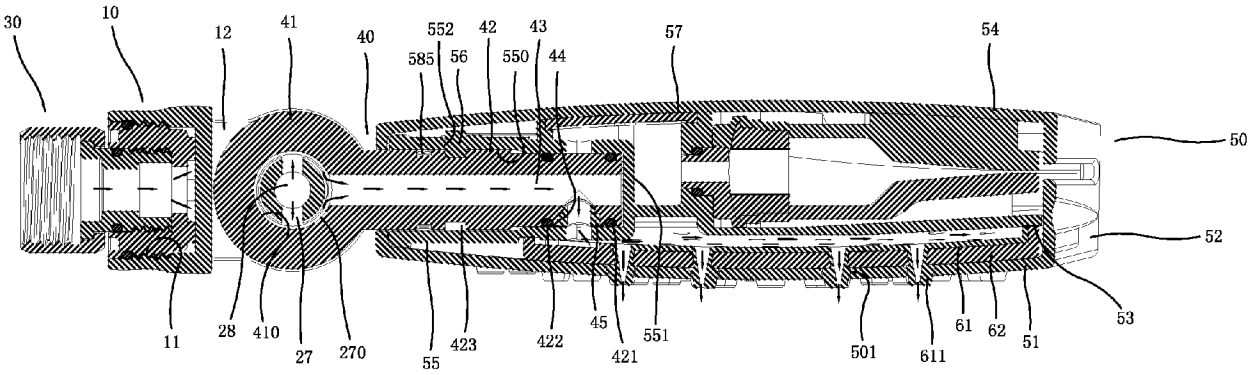
FIG. 5A is a cross-sectional view showing the first spray unit when in use according to the preferred embodiment of the present invention.

A first spray unit comprises a first spray head 61 disposed between the base 53 and the face panel 51. Referring to FIG. 5A, a first water chamber (not labeled) is formed between the base 53 and the first spray head 61. When the housing 50 is turned about the guide bolt 40 to the 0-degree position, the face panel 53 will be turned to face downward. The base 53 has a branch channel (not labeled) to communicate with the first water chamber and the guide channel 44 for supplying water to the first water chamber. The first spray head 61 has a plurality of cone-shaped spray nozzles 611 extending out of the first water holes 501 of the face panel 51 and accommodation holes 612 corresponding in position to the support pillars 511. The first spray unit further comprises a lining plate 62 disposed between the first spray head 61 and the face panel 51. The lining plate 62 has apertures 621 for insertion of the spray nozzles 611 of the first spray head 61 and lock seats 622 for insertion of the support pillars 511. The lock seats 622 pass through the accommodation holes 612 of the first spray head 61 to lean against the bottom of the base 53. The housing 50 and the base 53 are connected together through screws 512 and the support pillars 511.

Figure 5B:
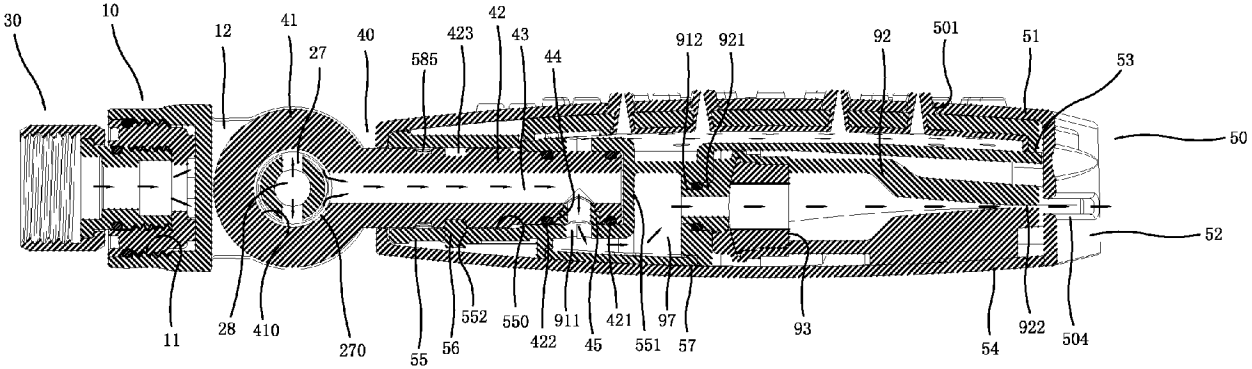
FIG. 5B is a cross-sectional view showing the fourth spray unit when in use according to the preferred embodiment of the present invention.
Figure 5C:
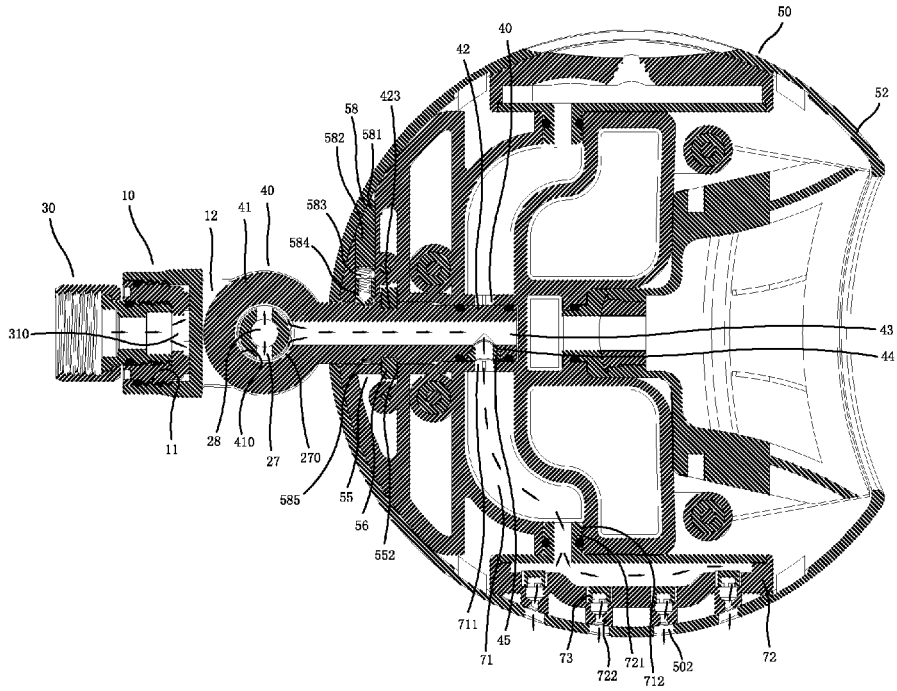
FIG. 5C is a cross-sectional view showing the second first spray unit when in use according to the preferred embodiment of the present invention.

A second spray unit comprises a second water chamber 71 facing upward on top of the base 53. The second water chamber 71 is located at the left side of the hole seat 55. A stop plate 57 is used to seal the top of the second water chamber 71. Referring to FIG. 5C, when the housing 50 is counterclockwise turned about the guide bolt 40 to the 90-degree position, the second water holes 502 will be turned to face downward. The hole seat 55 has a branch channel 711 to communicate with the second water chamber 71 and the guide channel 44 for supplying water to the second water chamber 71. The second water chamber 71 has a connecting hole 712 to connect with a connecting pipe 721 of a second spray head 72 for supplying water to the second spray head 72. The second spray head 72 has four spray nozzles 722 which are arranged in a strip form. The four spray nozzles 722 correspond in position to the second water holes 502 of the trunk portion 52. The second spray head 72 comprises separating members 73 therein. The second spray unit has a different spray mode from that of the first spray unit.

Figure 5D:
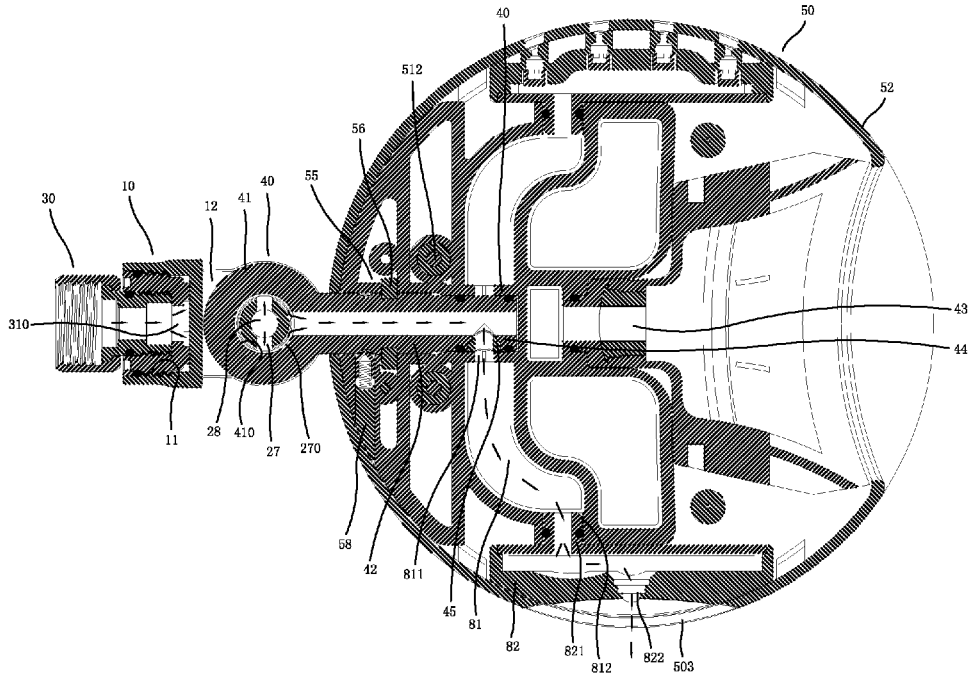
FIG. 5D is a cross-sectional view showing the third spray unit when in use according to the preferred embodiment of the present invention.

A third spray unit comprises a third water chamber 81 facing upward on top of the base 53. The third water chamber 81 is located at the right side of the hole seat 55. The stop plate 57 is used to seal the top of the third water chamber 81. Referring to FIG. 5D, when the housing 50 is counterclockwise turned about the guide bolt 40 to the 270-degree position, the third water holes 503 will be turned to face downward. The hole seat 55 has a branch channel 811 to communicate with the third water chamber 81 and the guide channel 44 for supplying water to the third water chamber 81. The third water chamber 81 has a connecting hole 812 to connect with a connecting pipe 821 of a third spray head 82 for supplying water to the third spray head 82. The third spray head 82 has a stepped spray nozzle 822 corresponding in position to the third water hole 503 of the trunk portion 52. The third spray unit has a different spray mode from those of the first spray unit and the second spray unit.

A fourth spray unit comprises a fourth water chamber 91 facing upward on top of the base 53. The fourth water chamber 91 includes a range to the inner end of the hole seat 55. The stop plate 57 is used to seal the top of the fourth water chamber 91. Referring to FIG. 5B, when the housing 50 is counterclockwise turned about the guide bolt 40 to the 180-degree position, the face panel 51 will be turned to face upward. The hole seat 55 has a branch channel 911 to communicate with the fourth water chamber 91 and the guide channel 44 for supplying water to the fourth water chamber 91. The fourth water chamber 91 has a connecting hole 912 to connect with a connecting pipe 921 of a fourth spray head 92 for supplying water to the fourth spray head 92. The fourth spray head 92 is composed of a pair of connected plates 92A, 92B. The fourth spray head 92 has a slot-shaped spray nozzle 922 corresponding in position to the fourth water hole 504 of the trunk portion 52. The fourth spray head 92 comprises a separating member 93 therein. The fourth spray unit has a different spray mode from those of the first spray unit, the second spray unit, and the third spray unit.

A positioning unit 58 includes a pin hole 581 on the base 58 and the hole seat 53 to communicate with the pivot hole 550. The outer end of the pin hole 582 is blocked with a block member 582, such that a pin 584 biased by a spring 583 is installed in the pin hole 581. The pin 584 is biased to be against the bolt shaft 42. The bolt shaft 42 has joint holes 585 for insertion of the pin 584 when the housing 50 relative to the shaft bolt 42 is counterclockwise turned to the 0-degree, 90-degree, 180 degree or 270-degree position, so that the housing 50 can be positioned at the 0-degree, 90-degree, 180 degree or 270-degree position.

Referring to FIGS. 3A, 3B, 5A, 5B, 5C and 5D, the user turns the housing 50 about the guide bolt 40 to communicate the guide channel 44 with the branch channel 711, 811 or 911 for changing different spray modes. The housing 50 is turned about the valve bolt 20 though the guide bolt 40 to adjust the angle of inclination of the desired spray unit, providing a user-friendly effect.

The present invention can be operated with ease, has a simple configuration, and is cost-effective.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-function shower head structure, comprising:

a connection base having a connection hole and a flow channel for supplying water;

a bolt connected to the connection base, the bolt having an inlet and an outlet;

a guide bolt pivoted to the bolt, the guide bolt having an axial conducting hole to communicate with the outlet, the axial conducting hole being rotatable about a central axis of the bolt, the guide bolt having a guide channel to communicate with the conducting hole;

a housing having a hole seat, the hole seat having a pivot hole for connection of the guide bolt, the housing being rotatable about the guide bolt; and a plurality of spray units, including a first spray unit, a second spray unit, a third spray unit, and a fourth spray unit, disposed in the housing, each of the spray units having a water chamber, a guide channel of the hole seat having a plurality of spaced branch channels corresponding to the respective water chambers to communicate with the pivot hole, when the housing is turned about the guide bolt, the branch channels being changed to communicate with the guide channel for different spray modes, the housing being turned about the bolt by means of the guide bolt to adjust the angle of inclination of the selected spray unit.

2. The multi-function shower head structure as claimed in claim 1, wherein the connection base has a left connection block, a right connection block and a rotation space defined between the two connection blocks, the two connection blocks having sink holes and through holes in the sink holes, the two through holes having the same central axis, the right connection block having spacers at an outer end of the through hole; the bolt having a shaft inserting in the through holes of the two connection blocks, one end of the shaft being an enlarged end to lean against spaces, another opposing end of the shaft being locked in the through holes with a screw, the flow channel being formed between every two of the spacers, the flow channel communicating with the connection hole, the bolt comprising a third washer and a fourth washer on the shaft within the rotation space, an annular groove on the shaft between the third washer and the fourth washer, an outlet under the annular groove, the shaft having an inlet corresponding in position to the flow channel, a shaft hole communicating with the inlet and the outlet for the outlet to output water; the guide bolt having a head end to be received in the rotation space, the head end having coupling holes to receive the third washer and the fourth washer, the guide bolt further comprising a bolt shaft opposite to the head end, the bolt shaft having a central axis perpendicular to that of the bolt, the bolt shaft having the axial conducting hole to communicate with the annular groove of the bolt.

3. The multi-function shower head structure as claimed in claim 1 or 2, further comprising a connector assembly, the connector assembly comprising an intermediary ring connected to the connection hole, the intermediary ring having an inner end provided with spaced stop blocks, a central guide hole to communicate with the flow channel and a threaded sleeve screwed in the guide hole of the intermediary ring, the threaded sleeve having a central sleeve hole to communicate with the flow channel, the threaded sleeve having an enlarged shoulder at an outer end thereof, the shoulder protruding out of the connection hole and the intermediary ring to connect with a stepped hole of a nut, the nut having an inner threaded hole to communicate with the sleeve hole.

4. The multi-function shower head structure as claimed in claim 1 or 2, wherein spaced washers are provided on the bolt shaft opposite to the head end, the bolt shaft having a guide channel between the spaced washers, the guide bolt with the spaced washers being coupled in the pivot hole of the hole seat.

5. The multi-function shower head structure as claimed in claim 4, wherein the guide bolt has a narrowed engaging groove thereon, the hole seat having an open slot corresponding in position to an engaging trough of the bolt shaft to communicate with the engaging trough, the engaging trough and the open slot accommodating a stop seat, the stop seat being locked on the hole seat to prevent the guide bolt from axial movement.

6. The multi-function shower head structure as claimed in claim 1 or 2, further comprising a positioning unit, the positioning unit including a pin hole on the housing and the hole seat to communicate with the pivot hole, a pin biased by a spring being installed in the pin hole, the pin being biased to be against the bolt shaft, the bolt shaft having joint holes for insertion of the pin when the housing relative to the shaft bolt is turned with the branch channels to communicate with the guide channel.

7. The multi-function shower head structure as claimed in claim 1 or 2, wherein the housing comprises a face panel, a trunk portion extending upward from the face panel, a base secured in the trunk portion, a cover on top of the trunk portion, and the hole seat fixed on the base, the face panel having a plurality of first water holes thereon for supplying water to the first spray unit, the trunk portion having a second water hole disposed on one side of the trunk portion, a third water hole on an opposing side of the trunk portion and a fourth water hole disposed between the second water hole and the third water hole for supplying water to the second spray unit, the third spray unit and the fourth spray unit; the trunk portion further having an insertion trough corresponding in position to the hole seat for the bolt shaft to pass therethrough.

8. The multi-function shower head structure as claimed in claim 7, wherein the first spray unit comprises a first spray head disposed between the base and the face panel, a first water chamber formed between the base and the first spray head, the housing being turned to have the face panel facing downward, the base having a branch channel to communicate with the first water chamber and the guide channel for supplying water to the first water chamber; the first spray head having a plurality of spray nozzles extending out of the first water holes of the face panel, the first spray unit further comprising a lining plate disposed between the first spray head and the face panel, the lining plate having apertures for insertion of the spray nozzles of the first spray head.

9. The multi-function shower head structure as claimed in claim 7, wherein the second spray unit comprises a second water chamber facing upward on top of the base, the housing being turned to have the second water hole facing downward, the hole seat having a branch channel to communicate with the second water chamber and the guide channel; the second water chamber being provided with a second spray head, the second spray head having a spray nozzle, the spray nozzle corresponding in position to the second water hole of the trunk portion, the second spray head comprising a separating member therein, the second spray unit having a different spray mode from that of the first spray unit.

10. The multi-function shower head structure as claimed in claim 7, wherein the third spray unit comprises a third water chamber facing upward on top of the base, the housing being turned to have the third water hole facing downward, the hole seat having a branch channel to communicate with the third water chamber and the guide channel; the third spray head having a spray nozzle corresponding in position to the third water hole of the trunk portion, the third spray unit having a different spray mode from those of the first spray unit and the second spray unit.

11. The multi-function shower head structure as claimed in claim 7, wherein the hole seat has a pivot hole at an outer end thereof for insertion of the guide bolt and an inner end of the hole seat is sealed by a block plate; the fourth spray unit comprising a fourth water chamber facing upward on top of the base, the fourth water chamber including a range to the inner end of the hole seat, the housing being turned to have the face panel facing upward, the hole seat having a branch channel to communicate with the fourth water chamber and the guide channel; the fourth spray head having a spray nozzle corresponding in position to the fourth water hole of the trunk portion, the fourth spray head comprising a separating member therein, the fourth spray unit having a different spray mode from those of the first spray unit, the second spray unit, and the third spray unit.

* * * * *